US008151818B2

(12) United States Patent
Wiens et al.

(10) Patent No.: US 8,151,818 B2
(45) Date of Patent: Apr. 10, 2012

(54) SYSTEM FOR SUPPLYING HYDRAULIC FLUID

(75) Inventors: Scott R. Wiens, Mannheim (DE); Helmut Schaefer, Ketsch (DE); Christian Brueser, Speyer (DE); Harm-Hendrik Lange, Bockenem (DE)

(73) Assignee: Deere & Company, Moline, IL (US)

( * ) Notice: Subject to any disclaimer, the term of this patent is extended or adjusted under 35 U.S.C. 154(b) by 403 days.

(21) Appl. No.: 12/551,725

(22) Filed: Sep. 1, 2009

(65) Prior Publication Data

US 2010/0051123 A1 Mar. 4, 2010

(30) Foreign Application Priority Data

Sep. 3, 2008 (DE) ..... 10 2008 041 799
Nov. 4, 2008 (DE) ..... 10 2008 043 449

(51) Int. Cl.
*F15D 1/00* (2006.01)

(52) U.S. Cl. ..... 137/205; 137/565.34; 137/571; 137/590

(58) Field of Classification Search ..... 137/205, 137/25, 565.01, 565.23, 565.34, 571, 590
See application file for complete search history.

(56) References Cited

U.S. PATENT DOCUMENTS 4,371,318 A 2/1983 Kime
4,445,829 A * 5/1984 Miller ..... 417/543
5,335,704 A * 8/1994 Haatveit ..... 141/95
5,775,103 A 7/1998 Ingvast
6,382,225 B1 * 5/2002 Tipton ..... 137/1
6,845,782 B2 * 1/2005 Osterkil et al. ..... 137/1
2008/0173356 A1 * 7/2008 Johnson et al. ..... 137/334

FOREIGN PATENT DOCUMENTS

DE 2822209 A1 11/1979

OTHER PUBLICATIONS

European Search Report dated Jul. 5, 2010 (4 pages).

* cited by examiner

*Primary Examiner* — Craig Schneider
*Assistant Examiner* — Ian Paquette

(57) ABSTRACT

The invention concerns a system for supplying hydraulic fluid to a hydraulic system, with an operating reservoir that accepts the hydraulic fluid provided for the operation of the hydraulic system and an auxiliary reservoir connected to the operating reservoir over a hydraulic line for intermediate storage of hydraulic fluid withdrawn from the operating reservoir. According to the invention, an air pump is available that is connected on the one hand on its low pressure side to a suction line that ends in a fluid free area of the auxiliary reservoir, so that a negative pressure can be built up in the auxiliary reservoir as against the external atmospheric pressure, and that is connected, on the other hand, to a control line that is provided with a control opening that is covered by the hydraulic fluid in the operating reservoir at least before the air pump is put into operation.

14 Claims, 3 Drawing Sheets

SYSTEM FOR SUPPLYING HYDRAULIC FLUID

FIELD OF THE INVENTION

This application claims priority based on German Application No. 10 2008 041 799.8, filed on Sep. 3, 2008 (Abandoned), and German Application No. 10 2008 043 449.3, filed on Nov. 4, 2008, which is hereby incorporated by reference in to this application. The present invention relates to a supply system for supplying hydraulic fluid to a hydraulic system.

BACKGROUND OF THE INVENTION

John Deere Tractors of the Series 6030 and 7030 use a system in which a charge oil pump continuously conveys hydraulic fluid against the force of gravity from an operating reservoir formed in the differential housing into an auxiliary reservoir located at a higher level, where the hydraulic fluid is charged starting from the auxiliary reservoir over a controllable high pressure pump into a hydraulic system for the operation of vehicle hydraulic units. Hydraulic fluid no longer required by vehicle units is conducted back into the operating reservoir. The vehicle hydraulic units include, in particular, a steering and braking system, as well, if necessary, agricultural implements that can be attached to the tractor and are provided with hydraulic positioning cylinders or the like. Depending on the hydraulic fluid consumption of the vehicle units, the fluid level in the operating reservoir can vary more or less significantly.

Since a pressure of several bar exists at the charge oil pump outlet in the conveying of the hydraulic fluid, this results in addition in increased demand for the capacity of the auxiliary reservoir to resist pressure. These lead to additional costs due to the associated increased costs of the configuration. If, for example, increased hydraulic fluid consumption occurs during operation of the vehicle units, there is the possibility, that the operating reservoir is completely emptied into the auxiliary reservoir due to the continued operation of the charge oil pump, so that the charge oil pump runs "dry", or is unlubricated during its continued operation. The latter condition may not only be detrimental to the durability of the charge oil pump, but in addition leads to an interruption of the lubrication of the differential gear in the differential housing. It is desired to have a.

SUMMARY OF THE INVENTION

Accordingly, an object of this invention is to provide a system which provides a constant supply of hydraulic fluid to the hydraulic system.

This and other objects are achieved by the present invention, wherein a system for supplying hydraulic fluid to a hydraulic system includes an operating reservoir to hold the hydraulic fluid provided for the operation of the hydraulic system as well as an auxiliary reservoir connected to the operating reservoir by a hydraulic line for the intermediate storage of hydraulic fluid withdrawn from the operating reservoir.

Moreover, an air pump is provided whose low pressure side is connected by a suction line to an inlet located in a portion the auxiliary reservoir which is free of fluid, so that in contrast to the surrounding atmospheric pressure a negative pressure can be built up in the suction line and hence in the auxiliary reservoir connected to it, and whose other side is connected with the control line that is provided with a control opening that is covered by the hydraulic fluid in the operating reservoir at least before the initial operation of the air conveying system.

If the air pump is put into operation, hydraulic fluid flows from the operating reservoir into the auxiliary reservoir over the hydraulic connection due to the negative pressure built up in the auxiliary reservoir over the suction line. Thereby the fluid level in the operating reservoir falls, where below a certain fluid level the control opening in the control line is open at least partially, so that the negative pressure built up in the auxiliary reservoir drops off to a value depending upon the flow resistance of the control opening as a result of the air drawn in over the control line from the surroundings. On the basis of the pressure drop, the fluid level swings back in the direction of the control opening so that the latter is again covered by hydraulic fluid. This process is repeated with decreasing intensity until a corresponding equilibrium level has developed in the operating reservoir. In other words, the fluid columns in both reservoirs connected to each other over the hydraulic line and stimulated into a damped vibration, where after the vibration decay depending on the position or the installed height and/or the flow resistance of the control opening a balance condition of the fluid level in the operating reservoir is developed or is controlled.

The air pump is preferably an electrically driven vacuum pump. Alternatively, the pump could be driven by an internal combustion engine of the vehicle through a V-belt connected to the engine.

Such a vacuum pump is already available on John Deere series 6030 and 7030 tractors as a component of a hydraulic supply of a vehicle drive interacting with an internal combustion engine, so that the system, according to the invention, can be realized at comparably small additional cost. Since merely a very small negative pressure of at most a few tenths of a bar is built up in the auxiliary reservoir no additional demands are placed on its capacity to withstand pressure.

In order to permit a readjustment of the fluid level in the operating reservoir in the case of a supply of hydraulic fluid as well as its withdrawal, it is advantageous that the hydraulic line extend between a lower area of the operating reservoir and a lower area of the auxiliary reservoir, so that the hydraulic fluid can flow easily between the two reservoirs.

Moreover, there is the possibility that several control openings particularly configured as throttle valves be provided in the control line. These are preferably arranged in such a way that they are freed successively when the negative pressure is built up on the basis of the decreasing fluid level in the operating reservoir. In this case decrease of the pressure in the control line occurs more slowly, so that the excitation of a damped vibration of the fluid columns located in the reservoirs and that are connected over the hydraulic line is largely suppressed. This favors a more rapid adjustment or control of a stable equilibrium condition of the fluid level in the operating reservoir.

The suction line may either be connected directly with the control line or it may be connected indirectly with it. In the latter case the control line can also end in the fluid free area of the auxiliary reservoir, so that the suction line and the control line communicate with each other only indirectly and that an undesirable penetration of hydraulic fluid drawn over the control line from the operating reservoir into the air pump is prevented.

Preferably the control opening in the control line is configured as a circular opening or a slot, where the latter may be oriented in the longitudinal direction of the control line. The control opening, in particular, may be formed by an end region projecting into the operating reservoir, for example by means of an open end of a control line. In the case of several control openings, these are preferably arranged one above the other in the end region of the control line.

Since during the operation of the hydraulic system the possibility exists that turbulence occurs in the hydraulic line that could lead to an undesired intrusion of air into the control line it is advantageous that the control line be surrounded by a shielding element in the region of the control opening. The shielding element is configured or arranged in such a way that an occurrence of turbulence in the area of the control opening is largely suppressed.

The shielding element in particular is a shielding pipe that is closed at its lower end by means of a screen through which fluid can pass. The cylindrical shielding pipe is configured in such a way that it forms a circular slot that is open upward together with the control line, by means of the control opening with which the hydraulic fluid located in the operating reservoir can communicate. Here the hydraulic fluid in the operating reservoir can drain off through the screen that is able to pass fluid.

In case that the operating reservoir is filled with hydraulic fluid to an excessive level there is the possibility that the fluid level in the operating reservoir may not drop sufficiently so as to open the controlled opening after the air pump had been put into operation due to the limited capacity of the auxiliary reservoir. In order to avoid intrusion of hydraulic fluid over the suction line or the control line into the air pump it is advantageous that a throttle valve be arranged in the suction line or the control line in order to reduce the negative pressure built up by means of the air pump to non critical values.

Basically it is conceivable that a reverse flow check valve be arranged in place of a throttle valve that is blocked against intrusion of hydraulic fluid. The reverse flow check valve contains a floating ball valve that is pressed against a valve seat in the case of intrusion of hydraulic fluid in such a way that an undesired flow of hydraulic fluid is prevented.

At low operating temperatures and consequent increased viscosity of the hydraulic fluid it is possible that after the air pump is brought into operation the hydraulic fluid located in the control line is not able to drain off in the direction of the operating reservoir and as a result the fluid level in the operating reservoir is not able to assume a stable equilibrium position. This can finally lead to overfilling of the auxiliary reservoir and thereby an intrusion of hydraulic fluid over the suction line into the air conveying line connected thereto. Therefore it is advantageous to provide a throttle valve in the control line ending in an area of the operating reservoir that is free of fluid, which reduces the negative pressure built up by means of the air pump in the suction line to non-critical values.

In addition, a pressure limiting valve may be arranged between the throttle valve and the air pump or between the reverse flow check valve and the air pump in such a way that it permits fluid flow when a predetermined negative pressure is exceeded in order to establish a pressure equalizing connection between the low pressure side of the air pump and the operating reservoir. For this purpose the pressure limiting valve is either arranged directly in a fluid free area of the operating reservoir or it is connected over a pressure equalizing line. In the latter case the pressure limiting valve is preferably arranged outside of the operating reservoir. Here the pressure limiting valve in particular is a conventional one way valve.

The system includes an operating reservoir to accept the hydraulic fluid provided for the operation of the hydraulic system. The operating reservoir is configured, for example, as a differential housing of a differential gearbox of an agricultural utility vehicle. Moreover, the system includes an auxiliary reservoir connected to the operating reservoir by a hydraulic line for the interim storage of hydraulic fluid withdrawn from the operating reservoir.

DESCRIPTION OF THE PREFERRED EMBODIMENT

Figure 1:
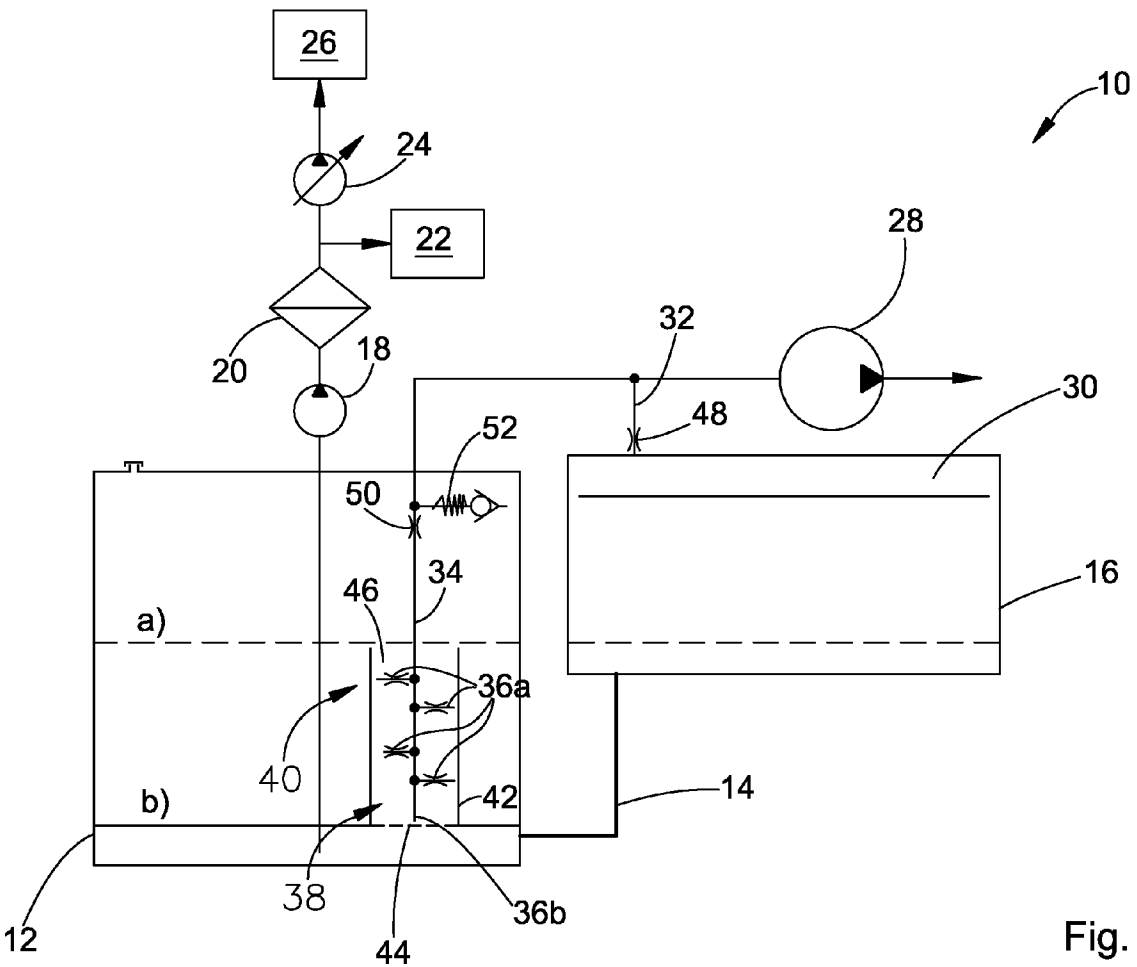
FIG. 1 is a schematic diagram of a first embodiment of a system for supplying hydraulic fluid to a hydraulic system.

FIG. 1 shows a first embodiment of a system 10 for supplying hydraulic fluid to a hydraulic system 26 in an agricultural utility vehicle (not shown). The vehicle may be a tractor, a harvesting machine, a forage harvester or a sprayer.

This system 10 may be located in an engine room or in the area of a gear box system of the vehicle. The system 10 includes an operating reservoir 12 that holds hydraulic fluid used in the operation of the hydraulic system, and an auxiliary reservoir 16 for the temporary storage or buffering of hydraulic fluid withdrawn from the operating reservoir 12. Auxiliary reservoir 16 is connected to the operating reservoir 12 by a hydraulic line 14.

The operating reservoir 12 may be formed by a differential gearbox housing of a gearbox included in the differential housing of the vehicle. The hydraulic fluid located in the differential housing simultaneously forms a sump for the lubrication of the differential gearbox. The hydraulic fluid in this case is conventional hydraulic oil or gearbox oil.

In order to permit a free flow back and forth of the hydraulic fluid between the two reservoirs 12 and 16, the hydraulic line 14 extends between a lower area of the operating reservoir 12 and a lower area of the auxiliary reservoir 16. Preferably, the auxiliary reservoir 16 is positioned at a higher level than the operating reservoir 12, so that the auxiliary reservoir 16 can drain completely into the operating reservoir 12.

The hydraulic fluid is pumped by a charge oil pump 18 through an intervening oil filter 20 to an internal combustion engine 22 of the vehicle as well as further power transmitting elements for purposes of lubrication (not shown). A controllable high pressure pump 24 downstream of the oil filter 20 supplies fluid to the hydraulic system 26. The hydraulic system 26 may include hydraulically operated vehicle components (not shown), such as a steering and braking assembly (not shown), or an attached implement (not shown) that can be attached to the vehicle, which is provided with hydraulic positioning cylinders (not shown) or the like. Hydraulic fluid no longer required or excess hydraulic fluid is thereby returned to the operating reservoir 12 over lines (not shown).

The system 10 also includes an air pump 28. The inlet or low pressure side of air pump 28 is connected by a suction line 32 to an inlet 33 located in a portion 30 of reservoir 16 which free of fluids, so that a negative pressure can be built up in the auxiliary reservoir 16, or a pressure which is lower than the surrounding atmospheric pressure of the environment. The inlet or low pressure side of air pump 28 is also connected by a control line 34 to several similar control openings **36*a*, configured as throttle, and to a control opening 36*b* formed by a downward opening end of the control line 34. The control openings 36*a* and 36*b* are completed submerged by hydraulic fluid in the operating reservoir 12, at least before the initial operation of the air pump 28, that is, before the buildup of the negative pressure in the auxiliary reservoir 16. This condition is shown in FIG. 1** by the fluid level indicated by a).

When the air pump 28 operates, then hydraulic fluid flows from the operating reservoir 12 into the auxiliary reservoir 16 against the force of gravity over the hydraulic line 14 because of the negative pressure built up in the auxiliary reservoir 16. This lowers the fluid level in the operating reservoir 12, so that the control opening 36*a* and subsequently the control opening 36*b* are successively freed, and the negative pressure built up in the suction line 32 drops off to a value as a result of the air drawn in from the surroundings to a value depending on the flow resistance of the control openings 36*a* and 36*b* that were just freed and is used for the adjustments or control of a corresponding equilibrium of the fluid level in the operating reservoir 12. This condition is indicated in FIG. 1 by the fluid level shown as b).

For example, the control openings 36*a* and 36*b* are arranged, one above the other, near the end region 38 of the control line 34 extending into the operating reservoir 12. The control openings 36*a* are arranged in the control line 34 as circular or slotted inlet openings, where the latter is oriented in the longitudinal direction of the control line 34. The control opening 36*b* formed by the open end of the control line 34 is typically provided with a diameter of about 25 mm.

At this point it should be noted that the control openings 36*a* and 36*b* only serve as an example. Alternatively, it is also conceivable that only a single control opening 36*b* be provided in the form of a downward opening of the control line 34.

The air pump 28 is preferably an electric vacuum pump or a conventional vacuum pump driven by the engine 22 of the vehicle. This generates a negative pressure in the auxiliary reservoir 16 in a typical magnitude of 50 mbar.

According to an advantageous further development of the system 10, the control line 34 is surrounded by a shielding element 40 in the area of the control openings 36*a* and 36*b*. The shielding element 40 is a cylindrical shielding pipe 42 that is closed at its lower end by means of a fluid permeable screen 44. The cylindrical shielding pipe 42 is dimensioned in such a way that it together with the control line 34 form a circular slot 46 that is open upward, with which the control openings 36*a* and 36*b* can communicate with the hydraulic fluid located in the operating reservoir 12.

When the operating reservoir 12 is filled to an excessive level with hydraulic fluid there is the possibility that the fluid level in the operating reservoir 12 is not able to drop sufficiently to open up the control openings 36*a* and particularly the control opening 36*b* due to the limited capacity of the auxiliary reservoir 16 after the air pump 28 is put into operation. In order to avoid an undesirable suction of hydraulic fluid into the suction line 32 or the control line 34 and finally into the air pump 28, a throttle or restriction 48 is placed in the suction line 32 or a throttle or restriction 50 is arranged the control line 34, that increases the negative pressure built up by means of the air pump 28 upon entry of hydraulic fluid, so that the pressure limiting valve 52 arranged between the throttle 48 or 50 and the air pump 28, becomes permeable when a predetermined negative pressure is exceeded and thereby establishes a pressure equalizing connection between the low pressure side of the air pump 28 and the operating reservoir 12. For this purpose, the pressure limiting valve 52 is arranged directly in a fluid free area of the operating reservoir 12. The pressure limiting valve 52 is a conventional one way valve.

Figure 2:
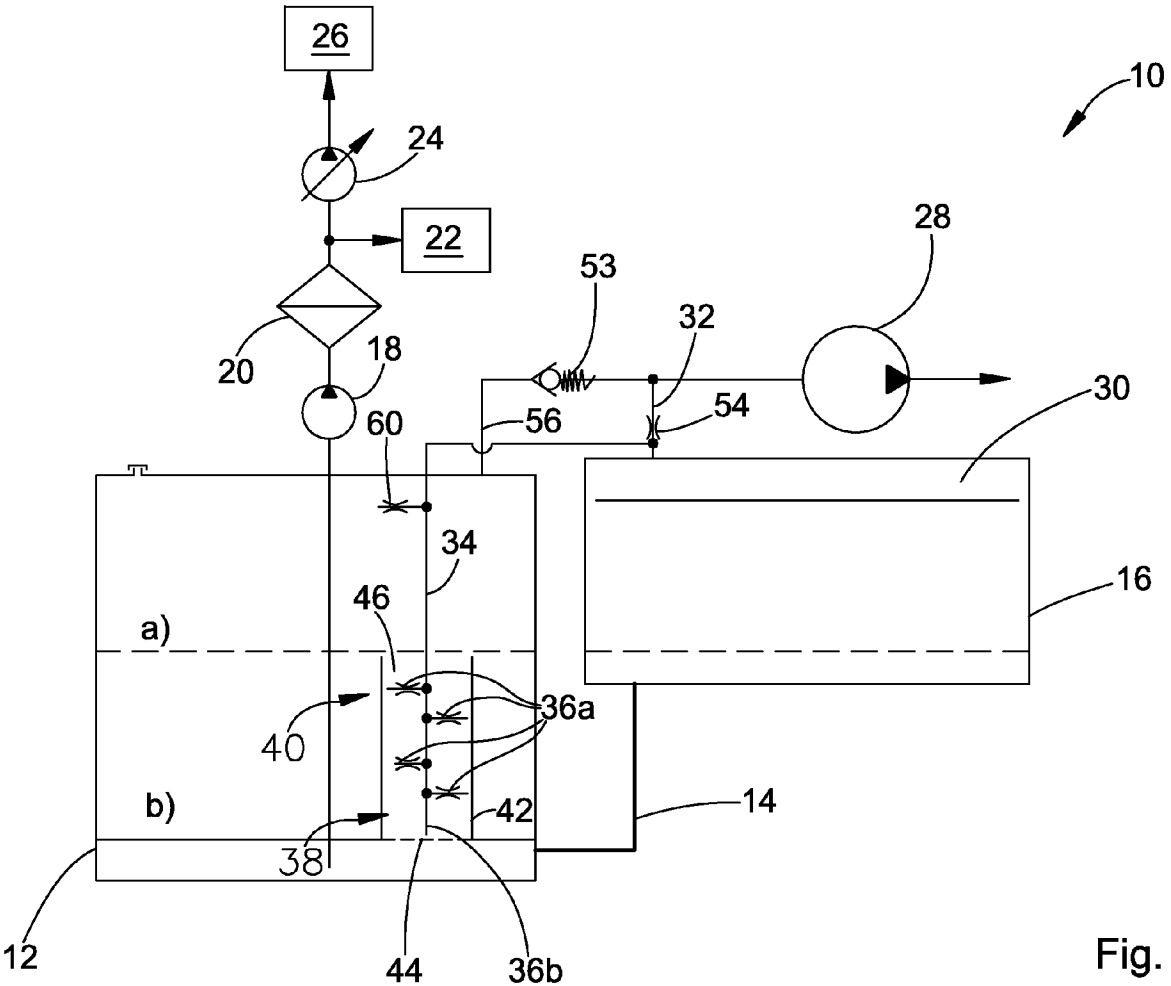
FIG. 2 is a schematic diagram of a second embodiment of the system for supplying of hydraulic fluid to a hydraulic system.

FIG. 2 shows a second embodiment of the system. This differs from the first embodiment of FIG. 1, insofar as that in place of the two throttles 48 and 50 only a single throttle 54 is provided. Moreover, a pressure limiting valve 53 is arranged outside of the operating reservoir 12 and is connected with the latter over a pressure equalizing line 56.

At low operating temperatures and with the resulting increased viscosity of hydraulic fluid, it is possible after the air pump 28 is put into operation, that the hydraulic fluid located in the control line 34 is not able to drain off in the direction of the operating reservoir 12 and therefore the fluid level in the operating reservoir 12 is unable to reach a stable equilibrium position. This finally can lead to an over filling of the auxiliary reservoir 16 and thereby suction of hydraulic fluid over the suction line 32 into the air pump 28. Therefore, a throttle 60 that opens into a fluid-free portion of the operating reservoir 12 is connected to the control line 34. Thus, at low operating temperatures and increased viscosity of the hydraulic fluid, the pressure limiting valve 53 (comparable to the throttle 54) prevents an excessive negative pressure from being built up in the suction line 32 upon initial operation of the air pump 28. The flow resistance of the throttle 60 is dimensioned in such a way that at normal operation temperatures a sufficiently large negative pressure can be built up in the suction line 32 that is connected to the control line 34 and thereby in the auxiliary reservoir 16.

Figure 3:
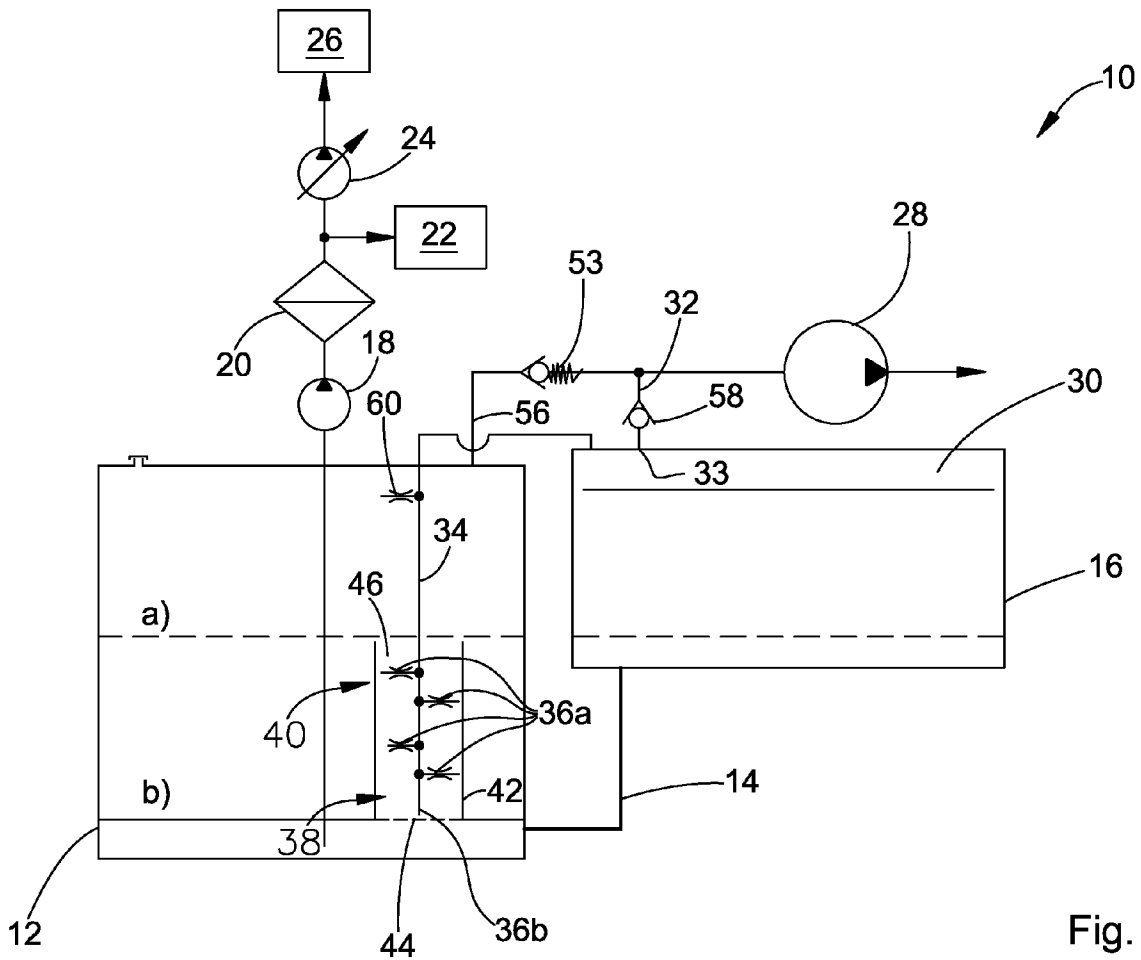
FIG. 3 is a schematic diagram of a third embedment of the system for supplying hydraulic fluid to a hydraulic system.

FIG. 3 shows a third embodiment of the system which differs from the system of FIG. 2 in such a way that a reverse flow check valve 58 is provided in place of the throttle 54, which is arranged so that it is blocked in case of an intrusion of hydraulic fluid. The reverse flow check valve 58 is provided with a floating ball valve that is forced against a valve seat in case of an intrusion of hydraulic fluid in such a way that an undesired through flow of hydraulic fluid is prevented.

In contrast to both of the above embodiments, the suction line 32 does not end directly in the control line 34. Rather, there is merely an indirect connection between the suction line 32 and the control line 34. For this purpose the control line 32 also ends in the fluid-free portion 30 of the auxiliary reservoir 16. Since the two lines 32 and 34 indirectly communicate with each other in this case an additional protection is provided against an undesired intrusion of hydraulic fluid drawn from the operating reservoir 12 over the control line 34 into the air pump 28 connected to the suction line 32. According to the example the suction line 32 and the control line 34 are connected to the upper side of the auxiliary reservoir 16.

While the present invention has been described in conjunction with a specific embodiment, it is understood that many alternatives, modifications and variations will be apparent to those skilled in the art in light of the foregoing description. Accordingly, this invention is intended to embrace all such alternatives, modifications and variations which fall within the spirit and scope of the appended claims.

We claim:

1. A supply system for supplying hydraulic fluid to a hydraulic system, the hydraulic system having an operating reservoir to hold hydraulic fluid and an auxiliary reservoir for the intermediate storage of hydraulic fluid withdrawn from the operating reservoir and connected by a hydraulic line to the operating reservoir, the supply system characterized by:

an air pump having an inlet connected by a suction line to a fluid free portion of the auxiliary reservoir, so that a negative pressure can be built up in the auxiliary reservoir as against the surrounding atmospheric pressure, and the inlet being connected by a control line to a control opening which is submerged in hydraulic fluid in the operating reservoir at least before the initial operation of the air pump.

2. The supply system of claim 1, wherein:
the hydraulic line extends between a lower portion of the operating reservoir and a lower portion of the auxiliary reservoir.

3. The supply system of claim 1, wherein:
the suction line is connected directly to the control line.

4. The supply system of claim 1, wherein:
the suction line is connected indirectly to the control line.

5. The supply system of claim 1, wherein:
the control opening is formed in an end region of the control line which extends into the operation reservoir.

6. The supply system of claim 1, wherein:
a plurality of control openings are formed in an end region of the control line which extends into the operating reservoir, and the control openings are arranged one above the other.

7. The supply system of claim 1, wherein:
the control opening is configured as a throttle.

8. The supply system of claim 1, wherein:
the control line is surrounded by a shielding element in the area of the control opening.

9. The supply system of claim 1, wherein:
a throttle is arranged in the suction line.

10. The supply system of claim 1, wherein:
a throttle is arranged in the control line.

11. The supply system of claim 1, wherein:
a reverse flow check valve is arranged in the suction line.

12. The supply system of claim 1, wherein:
a throttle is connected between the control line and the operating reservoir, throttle being located in a portion of the operating reservoir that is free of fluid.

13. The supply system of claim 1, wherein:
a pressure limiting valve is connected between the control line and the operating reservoir, the pressure limiting valve being connected to the control line at a location between a throttle and the air pump to establish a pressure equalizing connection between a low pressure side of the air pump and the operating reservoir.

14. The supply system of claim 1, wherein:
a pressure limiting valve is arranged between a reverse flow check valve and the air pump to establish a pressure equalizing connection between a low pressure side of the air pump and the operating reservoir.

* * * * *